US005988467A

United States Patent [19]

Brustein

[11] Patent Number: 5,988,467

[45] Date of Patent: Nov. 23, 1999

[54] INTER-LACING BOOT ANKLE HOLSTER

[76] Inventor: Samuel R. Brustein, 1635 Pirkle Rd. Apt. 1305, Norcross, Ga. 30093

[21] Appl. No.: 09/056,817

[22] Filed: Apr. 8, 1998

[51] Int. Cl.[6] ..... F41C 33/02; A45F 5/00

[52] U.S. Cl. ..... 224/222; 224/911; 224/587; 36/136

[58] Field of Search ..... 224/222, 267, 224/587, 911; 36/132, 136; 482/105

[56] References Cited

U.S. PATENT DOCUMENTS

| | | | |
|---|---|---|---|
| D. 106,649 | 10/1937 | Casey . | |
| D. 248,866 | 8/1978 | Gonzales . | |
| 348,233 | 8/1886 | Phalan . | |
| 1,155,506 | 10/1915 | Osaki . | |
| 3,278,184 | 10/1966 | Rosenbaum | 482/105 |
| 3,306,610 | 2/1967 | Biggs, Jr. et al. | 36/132 X |
| 3,334,898 | 8/1967 | McCrory et al. | 36/132 X |
| 3,427,020 | 2/1969 | Montour et al. | 36/132 X |
| 3,576,278 | 4/1971 | Eastman . | |
| 4,029,242 | 6/1977 | Stoesser . | |
| 4,258,871 | 3/1981 | McMahon . | |
| 4,410,118 | 10/1983 | Taurisano . | |
| 4,500,019 | 2/1985 | Curley, Jr. | 224/222 |
| 4,507,882 | 4/1985 | Harrell . | |
| 4,579,265 | 4/1986 | Schiller | 224/222 X |
| 4,763,821 | 8/1988 | Powell | 224/267 |
| 4,905,881 | 3/1990 | Graber | 224/222 |
| 5,058,788 | 10/1991 | Newmark . | |
| 5,148,949 | 9/1992 | Luca | 224/222 X |
| 5,351,370 | 10/1994 | Fields et al. . | |
| 5,727,341 | 3/1998 | Saylor | 224/911 X |

*Primary Examiner*—Gregory M. Vidovich
*Attorney, Agent, or Firm*—Tipton L. Randall

[57] ABSTRACT

The invention is an ankle holster for a handgun. The holster assembly wraps around the ankle of the wearer and has a fastener to fasten the ends together, such as buckles, snaps, clips, or hook and loop (Velcro) fastener tape. The holster assembly includes a plurality of eyelet apertures that are positioned adjacent the eyelet holes of the boot or shoe of the wearer. The holster assembly is held in position by inter-lacing the laces of the boot through the eyelet holes of the holster. This anchors the holster assembly in place and allows for a less constricting fit of the holster around the leg of the wearer.

18 Claims, 4 Drawing Sheets

INTER-LACING BOOT ANKLE HOLSTER

FIELD OF THE INVENTION

The invention relates to an ankle holster for a firearm and, more particularly, to a firearm ankle holster adapted to interlace with a boot or similar footwear on the foot of a wearer.

BACKGROUND OF THE INVENTION

Holsters for firearms that have been adapted to secure the weapon to the body of a person include shoulder holsters, and leg or ankle holsters. The term "holster" generally refers to an easily accessible enclosure for the firearm, with the enclosure secured to a fastening device, such as clips, straps, belts, etc. Ankle holsters are usually designed with a strap or belt to wrap around the ankle of the lower leg of the individual, just above the protruding ankle bone. If the individual is wearing a boot, the holster strap wraps around the boot or a combination of the boot and ankle. Firearms so secured are somewhat out of sight, and are designed to be quickly accessible with little effort. The ankle holster and firearm are commonly worn by law enforcement officers in the line of duty.

Ankle holsters presently available must be secured very tightly to the lower leg of the wearer to maintain the holstered firearm in a constant location. The tight fit of the ankle holster is also necessary since law enforcement officers often engage in strenuous physical activity that can cause the holster to shift or rotate around the ankle. Unless the holster is tight against the lower leg, rubbing may occur that will cause substantial discomfort, skin lesions and other problems. Moreover, it is important for fast drawing of the firearm secured in the holster that the holster remain at one position around the leg so that when the wearer reaches down to withdraw the firearm, the weapon is in the expected location.

Normally the firearm or handgun carried in an ankle holster is of a smaller caliber because the holster becomes uncomfortable if it is carrying too much weight. Presently the largest firearm comfortably carried in the available ankle holsters is a 0.380 caliber weapon. Law enforcement officers may feel the need to carry a larger caliber, heavier firearm, but find numerous drawbacks to doing so.

In order to maintain the ankle holster and contained firearm in position during strenuous physical activity, or to accommodate large caliber firearms, it is customary for wearers to secure the strap or belt of the ankle holster very tightly around the ankle area of the leg. This practice often results in constriction or restriction of vascular circulation in the ankle area. Further, it has been known that firearms held in such holsters can penetrate into the skin and flesh in the lower leg so as to pinch nerves, restrict movement of the foot relative to the ankle and leg, and to otherwise cause very serious medical problems. This is an ongoing problem since law enforcement officers will wear the ankle holster from eight to twelve hours a day, four to six days a week, over many years.

Various solutions to the ankle holster problem have been observed. Wearers have employed a second strap from the holster that wraps around the top of the calf to hold the holster in a more upright position. Large amounts of padding have been added on the inside of the strap or belt adjacent the location of the firearm. This padding adds weight, provides little additional comfort, and puts additional distance between the ankle and the holster, thus making the firearm and holster less concealable.

A number of innovations have been developed relating to devices for securing weapons or the like to the ankle, shoe or boot of an individual. The following U. S. patents are representative of some of those innovations.

Phalan, in U.S. Pat. No. 348,233, discloses an interior pocket permanently fastened within a boot for carrying small items.

A shoe support is shown by Osaki in U.S. Pat. No. 1,155,506.

Eastman, in U.S. Pat. No. 3,576,278, describes a knife scabbard with a sharpener contained in a pocket of the scabbard.

A detatchable shoe pocket device that is secured to the laces of a shoe is disclosed by Harrell in U.S. Pat. No. 4,507,882.

Fields et al., in U.S. Pat. No. 5,351,370, describes a boot lace storage device that is secured around a boot top.

A leg holster that fastens around both the ankle and the upper calf of the wearer is disclosed by Stoesser in U.S. Pat. No. 4,029,242, and by Newmark in U.S. Pat. No. 5,058,788.

A design patent by Gonzales, U.S. Des. 248,866, shows a leg holster with multiple straps possibly having hook and loop fasteners.

McMahon, in U.S. Pat. No. 4,258,871, and Taurisano, in U.S. Pat. No. 4,410,118, disclose "universal holster assembly" devices for firearms that can be secured to the body of the wearer at various locations.

Thus, there is an unmet need for a holster and holster assembly which securely and tightly holds a handgun or like firearm stationary relative to the lower leg, and proximate the ankle, but which need not be so tightly secured to the ankle region that vascular circulation is restricted. The needed holster must be capable of being worn for extended periods of time without encountering medical problems from loss of vascular circulation, pinched nerves or other problems that a tourniquet-like device causes.

SUMMARY OF THE INVENTION

The invention is a holster assembly removably securing a handgun to a human leg of a wearer. The assembly comprises a firearm holster member having an opening removably retaining a firearm. A leg encircling member is connected to the holster member. The encircling member is selectively connected about the leg of a wearer, near an ankle bone, by fastening means attached to the encircling member. A plurality of eyelet apertures in the leg encircling member are positioned to accept a lace member from a foot covering worn by the wearer. The leg encircling member and attached holster member are held in an essentially constant orientation with the leg of the wearer by the eyelet aperture members accepting the lace member from a foot covering worn by the wearer.

DESCRIPTION OF THE PREFERRED EMBODIMENTS

Nomenclature

Figure 1:
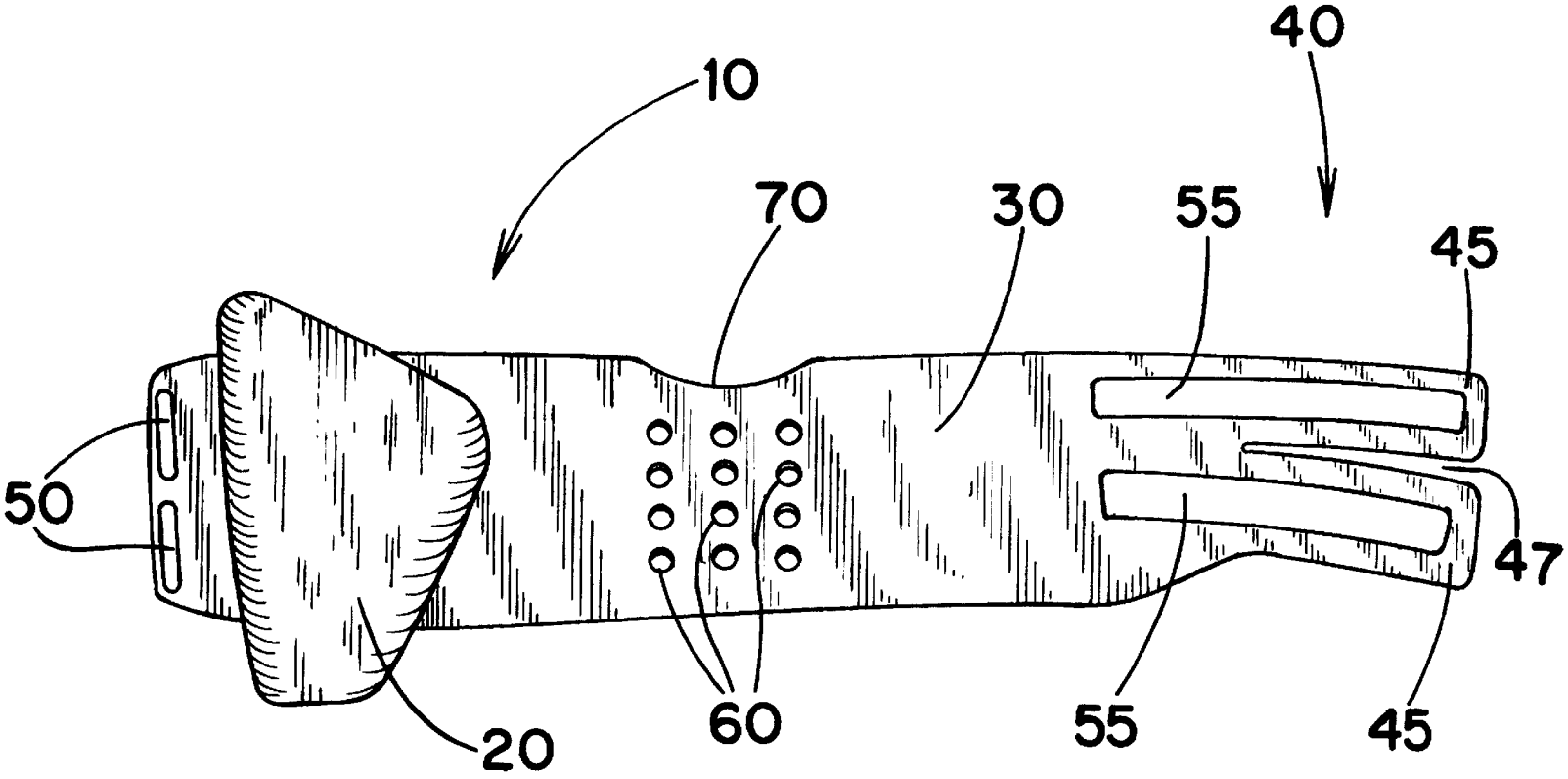
FIG. 1 is the ankle holster assembly of the present invention.

10—Holster Assembly
20—Firearm Holster Member
30—Leg Encircling Strap Member
40—Fastening Means
45—Fastening Strip Members
47—Horizontal Notch in Strap Member
50—Aperture Slits in Leg Encircling Strap Member
55—Hook and Loop Fastening Tape
60—Eyelet Apertures in Leg Encircling Strap Member
70—Cutout Notch in Leg Encircling Strap Member
H—Handgun
L—Laces of Foot Covering
B—Boot
W—Wearer's Leg Construction Referring to FIG. 1, the holster assembly 10 of the present invention is shown. The assembly 10 includes a firearm holster member 20 that removably retains a firearm such as a handgun. The holster member 20 is fastened to a leg encircling member, which in this case is a flat, generally rectangular strap member 30. The holster member 20 is positioned near a first end of the strap member 30. The second end of the strap member 30 has a fastening means 40 used to secure the strap member 30 and attached holster member 20 around the ankle of the wearer. In this embodiment of the invention, the fastening means is a pair of fastener strips 45 extending from the second end of the strap member 30. It is preferred that the fastener straps 45 be integrally formed with the strap member 30. This is accomplished by simply cutting a long, horizontal notch 47 in the second end of the strap member 30, dividing the second end of the strap member 30 approximately in half, thus producing the pair of fastener straps 45. The fastener strips 45 are sized to fit through corresponding aperture slits 50 positioned near the first end of the strap member 30. The fastener strips 45 can be easily trimmed in width to easily fit through aperture slits 50. The fastener strips 45 have sections of hook and loop fastener tape 55 secured to their outer surface. Upon inserting the fastener strips 45 through the corresponding aperture slits 50 and drawing the holster assembly 10 snugly around the ankle of the wearer, the fastener strips 45 can fold back upon themselves, with the hook and loop fastening tape 55 overlapping to hold the strips 45 in place.

The strap member 30 also contains a plurality of eyelet apertures 60 positioned centrally on the strap member 30. The number of eyelet apertures 60 can vary from two to twenty. In the embodiment of the invention shown in FIG. 1, the eyelet apertures 60 are arranged in three vertical rows containing four eyelet apertures 60 each, although other numbers and arrangements of the eyelet apertures 60 are contemplated.

Figure 2:
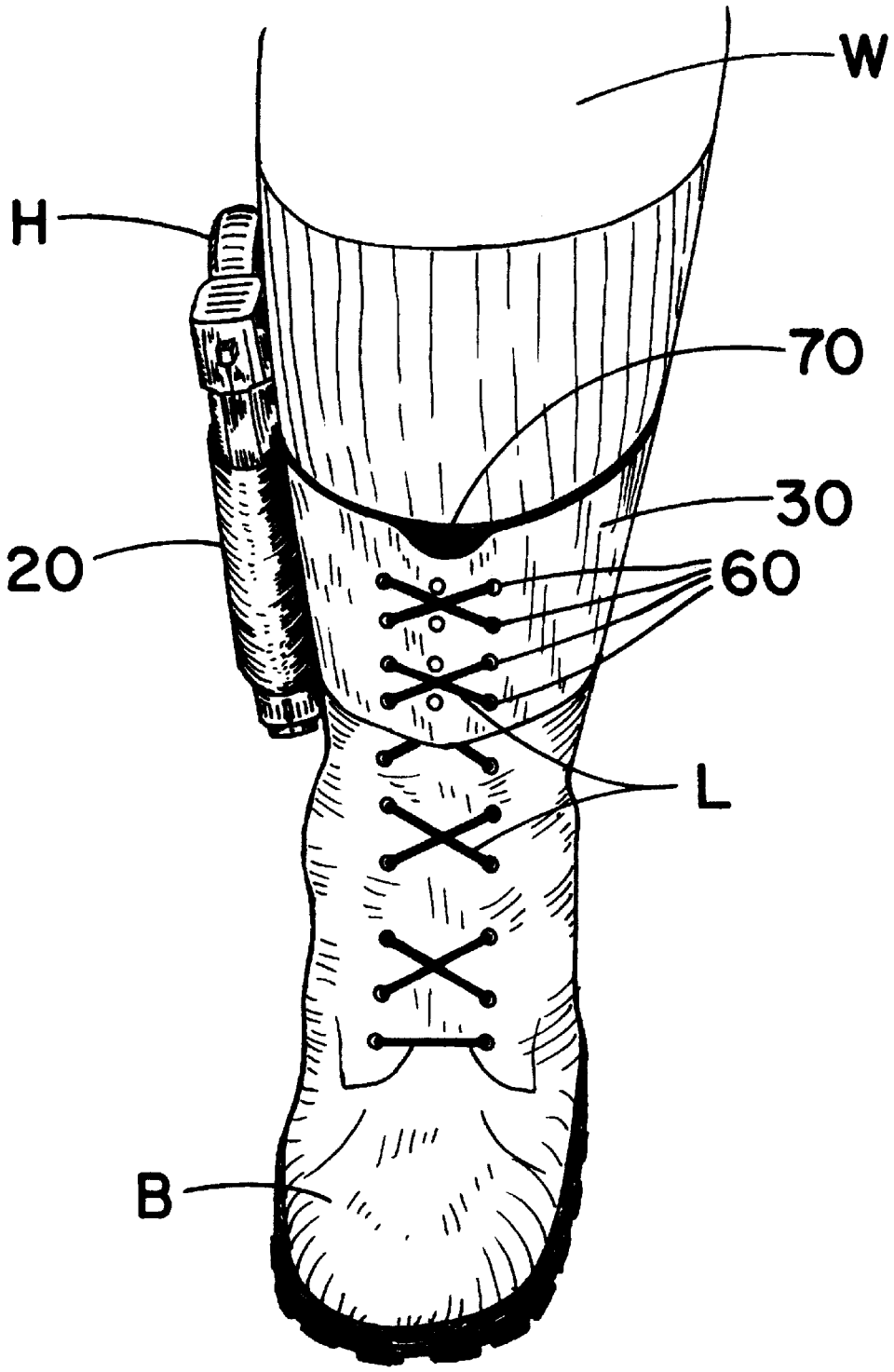
FIG. 2 is a front view of the holster assembly on the ankle of a wearer.
Figure 3:
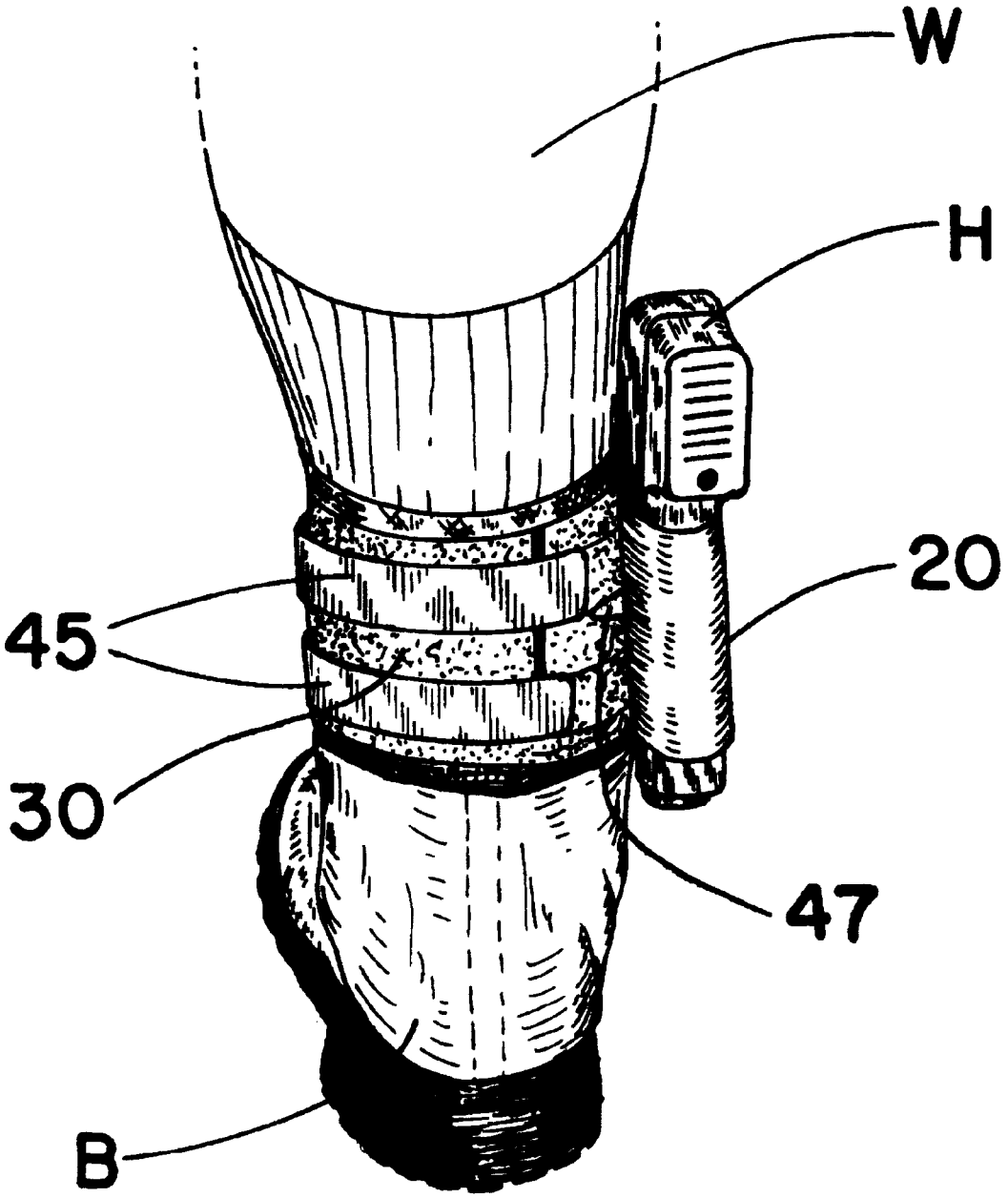
FIG. 3 is a rear view of the holster assembly on the ankle of a wearer.
Figure 4:
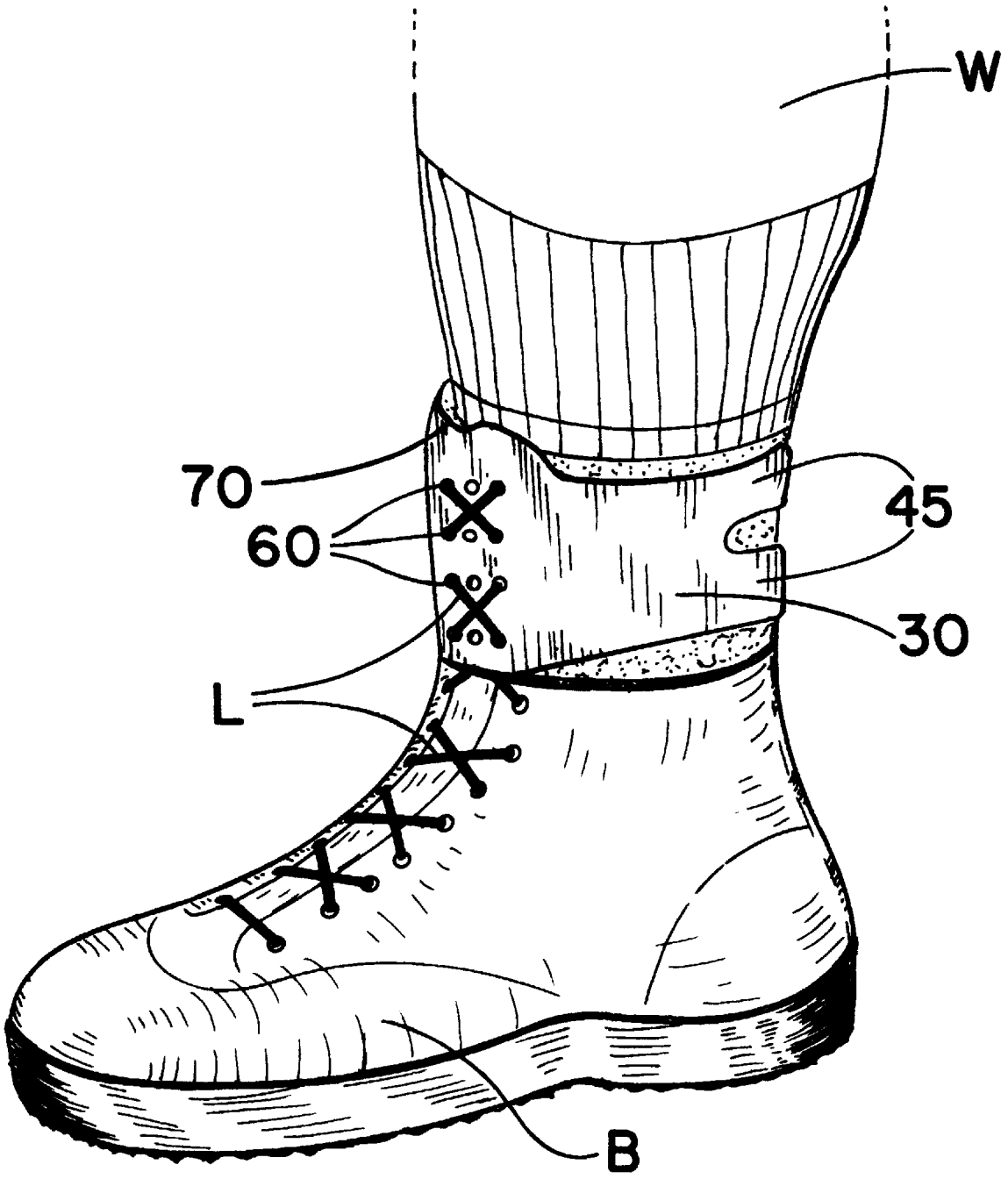
FIG. 4 is a side view of the holster assembly on the ankle of a wearer.

The function of the eyelet apertures 60 is best seen in FIGS. 2–4, where the holster assembly 10, containing a handgun H in the firearm holster member 20, is secured around the ankle of the wearer's leg W. The eyelet apertures 60 are positioned on the strap member 30 to accept the laces L from the shoe or boot B of the wearer, thereby holding the holster assembly 10 and handgun H in an essentially constant orientation on the ankle of the wearer. The number of eyelet apertures 60 in the strap member 30 can vary from two to twenty, with the larger number of eyelets allowing the holster assembly 10 to be positioned on the ankle according to the particular needs or preferences of each individual wearer. Some wearers may prefer the firearm holster member 20 to be positioned closer to the front of the ankle, while others may prefer the holster member 20 near the back of the ankle. The multiplicity of eyelet apertures 60 distributed over the center portion of the strap member 30 allows the holster member 20 to be positioned for these individual preferences.

To function properly, the wearer of the holster assembly 10 must have a foot covering that extends at least close to the ankle area. A three quarter height shoe or boot is needed to provide laces L in position to be interlaced with the eyelet apertures 60 of the holster assembly 10. In fact, a large majority of law enforcement officers are known to wear high top shoes or boots suitable for use with the present invention.

The simplest method for securing the holster assembly 10 on the ankle of a wearer's leg W is to first interlace the boot laces L through the eyelet apertures 60 of the assembly 10, then use the fastening means 40 to secure the strap member 30 around the wearer's ankle, and finally place the handgun H in the holster member 20. There is also provided a optional small cutout notch 70 on the upper edge of the strap member 30. The cutout notch 70 is located directly above the plurality of eyelet apertures 60, and allows the ends of the boot laces L to extend above the top edge of the strap member 30 where the laces L are tied together to secure them in place.

The holster assembly 10 of the present invention containing a handgun H is thus securely held in position around the ankle of the wearer. The strap member 30 need not be tightened to the point of discomfort for proper function. The anchoring of the holster assembly 10 and handgun H via the boot laces L interlaced through the eyelet apertures 60 maintains the holster member 10 at a constant position on the ankle of the wearer. The holster assembly 10 is thus prevented from rotating around on the ankle of the wearer. This feature is particularly important when the wearer engages in strenuous physical activity as might a law enforcement officer. Additionally, should the fastening means 40 securing the leg encircling strap member 30 around the wearer's ankle become disconnected, the interlacing of the boot laces L with the eyelet apertures 60 maintains the handgun H and holster assembly 10 at the wearer's ankle area. The anchoring feature of the holster assembly 10 also supports the weight of the handgun H, allowing the wearer to carry a larger caliber, heavier weapon if so desired.

The firearm holster member 20 may be fabricated from leather, plastic, metal, fabric or similar material. A synthetic plastic material sold under the trademark Kydex® is particularly well suited for use as the holster member 20. The leg encircling strap member 30 is preferably fabricated from leather, although woven fabrics such as canvas, nylon, or the like are equally suitable. The fastening means 40, for securing the two ends of the strap member 30 around the ankle of the wearer's leg W, may include a single hook and loop D-type strap, a buckle, elastic hook and loop straps, snaps, clips, buttons or other suitable attaching devices.

The holster assembly 10 of the present invention is also applicable to carrying other weapons, such as a knife or the like, secured at the ankle of the wearer. The weapon retainer is adapted to accept the particular weapon chosen for carrying by the wearer.

While the invention has been particularly shown and described with reference to a preferred embodiment thereof, it will be understood by those skilled in the art that various changes in form and details may be made therein without departing from the spirit and scope of the invention.

I claim:

1. A holster assembly removably securing a handgun to a human leg of a wearer comprising;

a) a firearm holster member having an opening for removably retaining a firearm;

b) a leg encircling member connected to said holster member, said encircling member adapted for selective connection about a wearer's leg, near an ankle bone thereof, by fastening means attached to said encircling member;

c) a plurality of eyelet apertures in said leg encircling member positioned to accept a lace member from a foot covering worn by the wearer, wherein said leg encircling member and holster member attached thereto being held in an essentially constant orientation with the wearer's leg by said eyelet apertures accepting the lace member from the wearer's foot covering; and d) a cutout notch in an upper edge of said leg encircling member, said cutout notch positioned directly above said plurality of eyelet apertures to accommodate the lace member from the wearer's foot covering.

2. A holster assembly according to claim 1 wherein said leg encircling member connected to said holster member is a flat, generally rectangular strap member with first and second ends.

3. A holster assembly according to claim 1 wherein said leg encircling member connected to said holster member is fabricated from leather.

4. A holster assembly according to claim 1 wherein said leg encircling member connected to said holster member is fabricated from a woven fabric.

5. A holster assembly according to claim 1 wherein said connecting means is selected from the group consisting of hook and loop tape fasteners, a buckle, snaps, clips and buttons.

6. A holster assembly according to claim 2 wherein said plurality of eyelet apertures are positioned centrally on said rectangular strap member.

7. A holster assembly according to claim 1 wherein said plurality of eyelet apertures comprises two to twenty eyelet apertures.

8. A holster assembly according to claim 7 wherein said plurality of eyelet apertures comprises three vertical rows of four eyelet apertures each.

9. A holster assembly removably securing a handgun to a human leg of a wearer comprising;

a) a firearm holster member having an opening for removably retaining a firearm;

b) a leg encircling generally rectangular strap member connected to said holster member, said encircling strap member adapted for selective connection about a wearer's leg, near an ankle bone thereof, by fastening means attached to said encircling strap member;

c) a plurality of eyelet apertures in said leg encircling strap member positioned to accept a lace member from a foot covering worn by the wearer, wherein said leg encircling strap member and holster member attached thereto being held in an essentially constant orientation with the wearer's leg by said eyelet apertures accepting the lace member from the wearer's foot covering; and d) a cutout notch in an upper edge of said leg encircling member, said cutout notch positioned directly above said plurality of eyelet apertures to accommodate the lace member from the wearer's foot covering.

10. A holster assembly according to claim 9 wherein said leg encircling strap member connected to said holster member is fabricated from leather.

11. A holster assembly according to claim 9 wherein said leg encircling strap member connected to said holster member is fabricated from a woven fabric.

12. A holster assembly according to claim 9 wherein said connecting means is selected from the group consisting of hook and loop tape fasteners, a buckle, snaps, clips and buttons.

13. A holster assembly according to claim 9 wherein said plurality of eyelet apertures are positioned centrally on said rectangular strap member.

14. A holster assembly according to claim 9 wherein said plurality of eyelet apertures comprises two to twenty eyelet apertures.

15. A holster assembly according to claim 14 wherein said plurality of eyelet apertures comprises three vertical rows of four eyelet apertures each.

16. A weapon carrying system for a human wearer comprising:

a) a lace member containing foot covering securable on a wearer's foot and lower leg; and b) a holster assembly attached to said lace member containing foot covering securable on a wearer's foot and lower leg, said holster assembly comprising;

i) a firearm holster member having an opening for removably retaining a firearm;

ii) a leg encircling member connected to said holster member, said encircling member adapted for selective connection about a wearer's leg, near an ankle bone thereof, by fastening means attached to said encircling member; and iii) a plurality of eyelet apertures in said leg encircling member positioned to accept said lace member from said foot covering securable on a wearer's foot and lower leg, wherein said leg encircling member and holster member attached thereto being held in an essentially constant orientation with the wearer's leg by said eyelet apertures accepting said lace member from the lace containing foot covering.

17. A weapon carrying system according to claim 16 wherein said plurality of eyelet apertures comprises two to twenty eyelet apertures.

18. A weapon carrying system according to claim 17 wherein said plurality of eyelet apertures comprises three vertical rows of four eyelet apertures each.

* * * * *